US007257948B1

(12) United States Patent
Bennett

(10) Patent No.: US 7,257,948 B1
(45) Date of Patent: Aug. 21, 2007

(54) DUAL PUMP APPARATUS

(75) Inventor: Michael L. Bennett, Sullivan, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 0 days.

(21) Appl. No.: 11/316,314

(22) Filed: Dec. 21, 2005

(51) Int. Cl.
*F04B 1/22* (2006.01)
*F04B 23/00* (2006.01)

(52) U.S. Cl. ..... 60/486; 60/488

(58) Field of Classification Search ..... 60/486, 60/488
See application file for complete search history.

(56) References Cited

U.S. PATENT DOCUMENTS 1,539,616 A 5/1925 Williams
2,875,701 A 3/1959 Ebert
2,914,219 A 11/1959 Chiantelassa
3,177,666 A * 4/1965 Reinke ..... 60/488
3,362,161 A * 1/1968 Flint ..... 60/488
3,922,931 A 12/1975 Osujyo et al.
4,167,855 A 9/1979 Knapp
4,252,508 A 2/1981 Forster
4,270,408 A 6/1981 Wagner
4,534,271 A 8/1985 Forster
4,819,508 A 4/1989 Yamaoka et al.
4,856,368 A 8/1989 Fujisaka et al.
4,870,820 A 10/1989 Nemoto
4,899,541 A 2/1990 Okada et al.
4,905,472 A 3/1990 Okada
4,914,907 A 4/1990 Okada
4,932,209 A 6/1990 Okada et al.
4,934,253 A 6/1990 Berthold et al.
4,971,535 A 11/1990 Okada et al.
4,986,073 A 1/1991 Okada
5,040,429 A 8/1991 Del Castillo
5,042,252 A 8/1991 Havens et al.
5,074,195 A 12/1991 Ohashi et al.
5,078,222 A 1/1992 Hauser et al.
5,094,077 A 3/1992 Okada
5,136,845 A 8/1992 Woodley
5,146,748 A 9/1992 Okada
5,156,576 A 10/1992 Johnson
5,163,293 A 11/1992 Azuma et al.
5,182,966 A 2/1993 von Kaler et al.
5,201,692 A 4/1993 Johnson et al.
5,207,060 A 5/1993 Sheets
5,247,794 A * 9/1993 Benson et al. ..... 60/487
5,289,738 A 3/1994 Szulczewski
5,304,043 A 4/1994 Shilling
5,311,740 A 5/1994 Shiba et al.
5,314,387 A 5/1994 Hauser et al.

(Continued)

*Primary Examiner*—Thomas E. Lazo
(74) *Attorney, Agent, or Firm*—Neal, Gerber & Eisenberg LLP

(57) ABSTRACT

A dual pump apparatus having first and second pump housings is disclosed. A first end cap is mounted to the first housing to form a first sump and a first pump cylinder block is located therein. A second end cap is mounted to the second housing to form a second sump and a second pump cylinder block is located therein. A charge pump is sandwiched between the end caps to provide charged hydraulic fluid to one or both cylinder blocks. An input shaft having a first end external to the hydraulic pump apparatus extends into both housings to simultaneously drive the first pump cylinder block, the second pump cylinder block and the charge pump.

19 Claims, 6 Drawing Sheets

U.S. PATENT DOCUMENTS 5,330,394 A 7/1994 Hauser et al.
5,333,451 A 8/1994 Sakikawa et al.
5,335,496 A 8/1994 Azuma et al.
5,339,631 A 8/1994 Ohashi
5,354,180 A 10/1994 Forster
5,373,697 A 12/1994 Jolliff et al.
5,440,951 A 8/1995 Okada et al.
5,501,578 A 3/1996 Skirde
5,546,752 A 8/1996 Horton et al.
5,555,727 A 9/1996 Hauser et al.
5,588,294 A 12/1996 Sakaura et al.
5,628,189 A 5/1997 Hauser et al.
5,771,758 A 6/1998 Hauser
5,794,443 A 8/1998 Shimizu
5,800,134 A 9/1998 Hasegawa et al.
5,819,537 A 10/1998 Okada et al.
5,862,868 A 1/1999 Okada et al.
5,873,287 A 2/1999 Kawada
5,887,484 A 3/1999 Abend et al.
5,913,950 A 6/1999 Matsufuji
5,957,666 A 9/1999 Lee
6,022,198 A * 2/2000 Hoffmeister ..... 417/203
6,332,393 B1 12/2001 Trimble
6,361,282 B1 * 3/2002 Wanschura ..... 417/206
6,474,218 B2 11/2002 Saito et al.
6,487,856 B1 12/2002 Ohashi et al.
6,494,686 B1 12/2002 Ward
6,682,312 B1 1/2004 Ward
6,705,840 B1 3/2004 Hauser et al.
6,736,605 B2 5/2004 Ohashi et al.

* cited by examiner

DUAL PUMP APPARATUS

BACKGROUND OF THE INVENTION

This application relates to hydraulic pumps in general and to a dual pump apparatus in particular.

SUMMARY OF THE INVENTION

The present invention comprises a dual pump apparatus having multiple housing members and sumps and a single charge pump preferably located between the two pumps. The two pumps and the charge pump are preferably driven by a unitary pump input shaft.

A better understanding of the objects, advantages, features, properties and relationships of the invention will be obtained from the following detailed description and accompanying drawings which set forth an illustrative embodiment and is indicative of the various ways in which the principles of the invention may be employed.

DETAILED DESCRIPTION OF THE DRAWINGS

Figure 1:
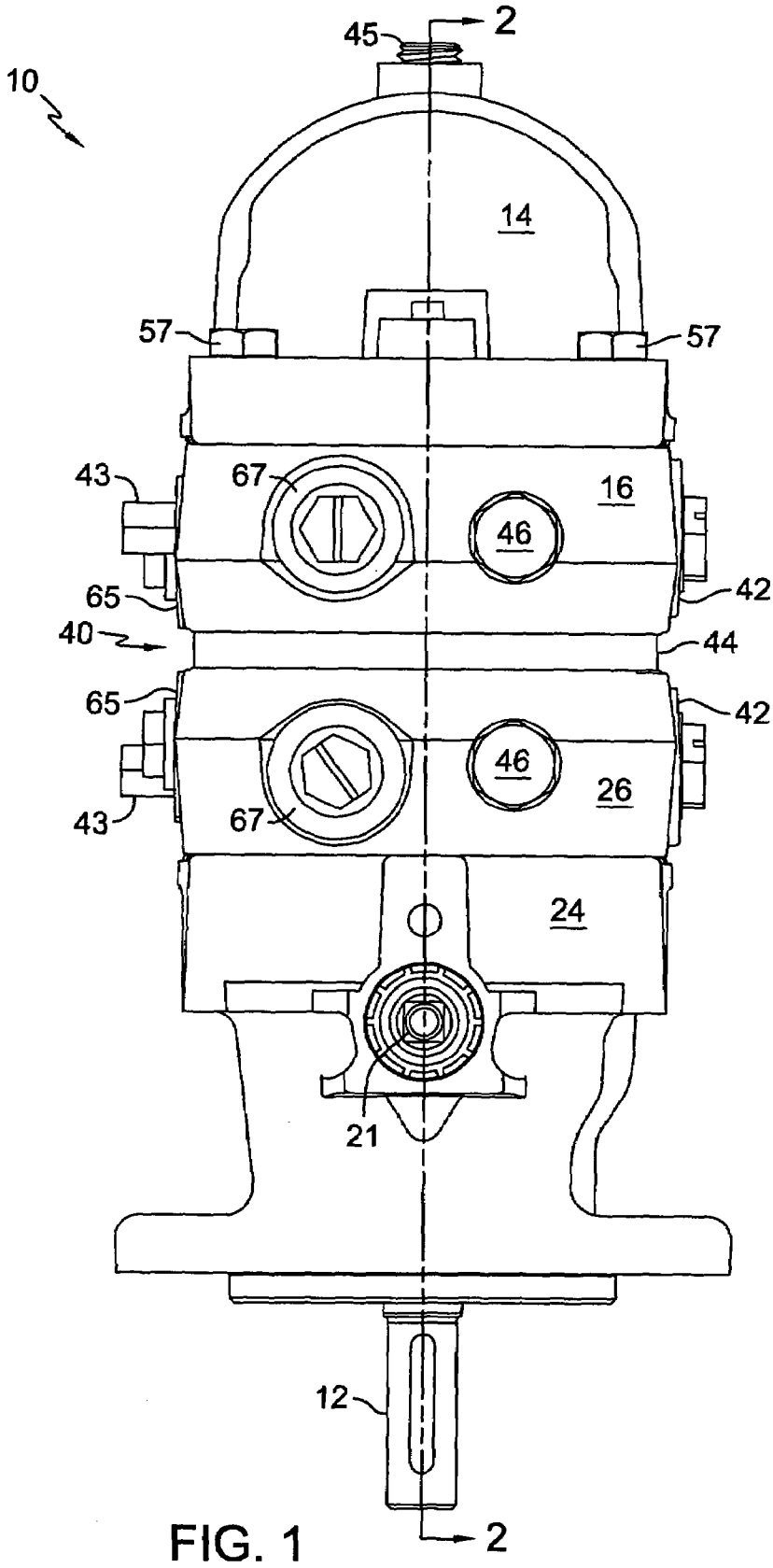
FIG. 1 is an elevational view of a dual pump apparatus in accordance with a first embodiment of the present invention.
Figure 2:
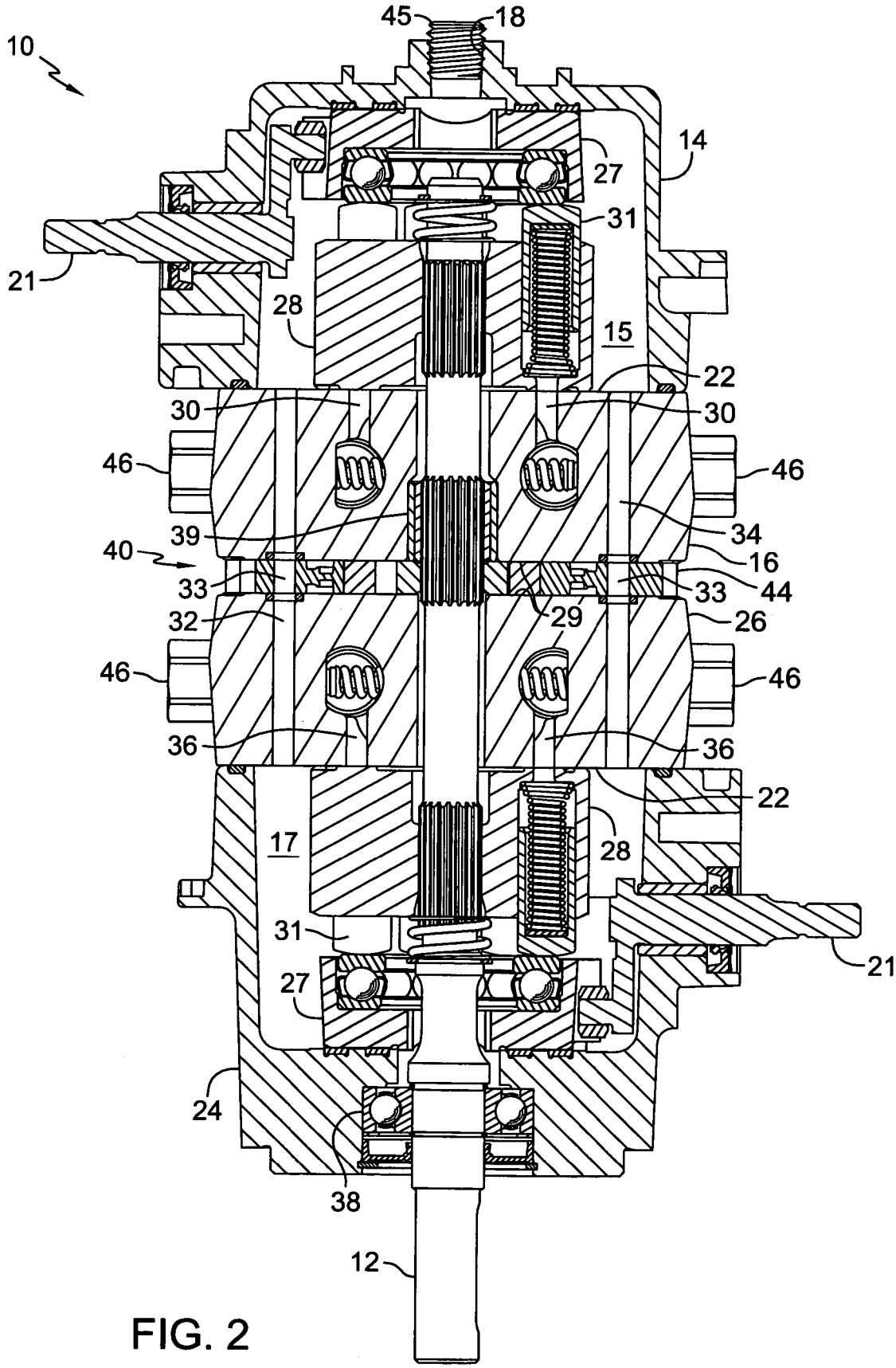
FIG. 2 is a cross-sectional view of the dual pump apparatus along the lines 2—2 of FIG. 1.
Figure 3:
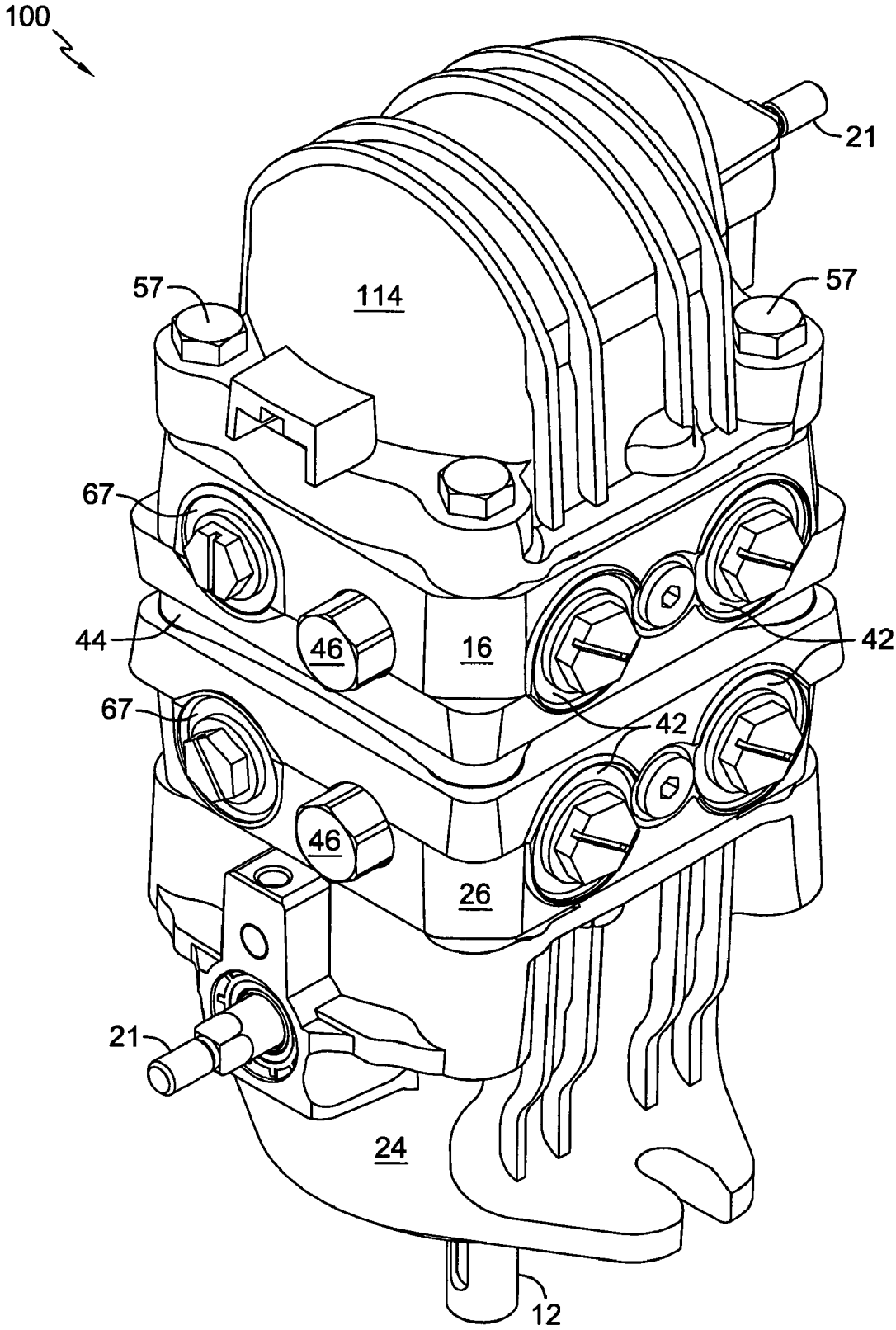
FIG. 3 is a perspective view of a dual pump apparatus in accordance with a second embodiment of this invention.
Figure 4:
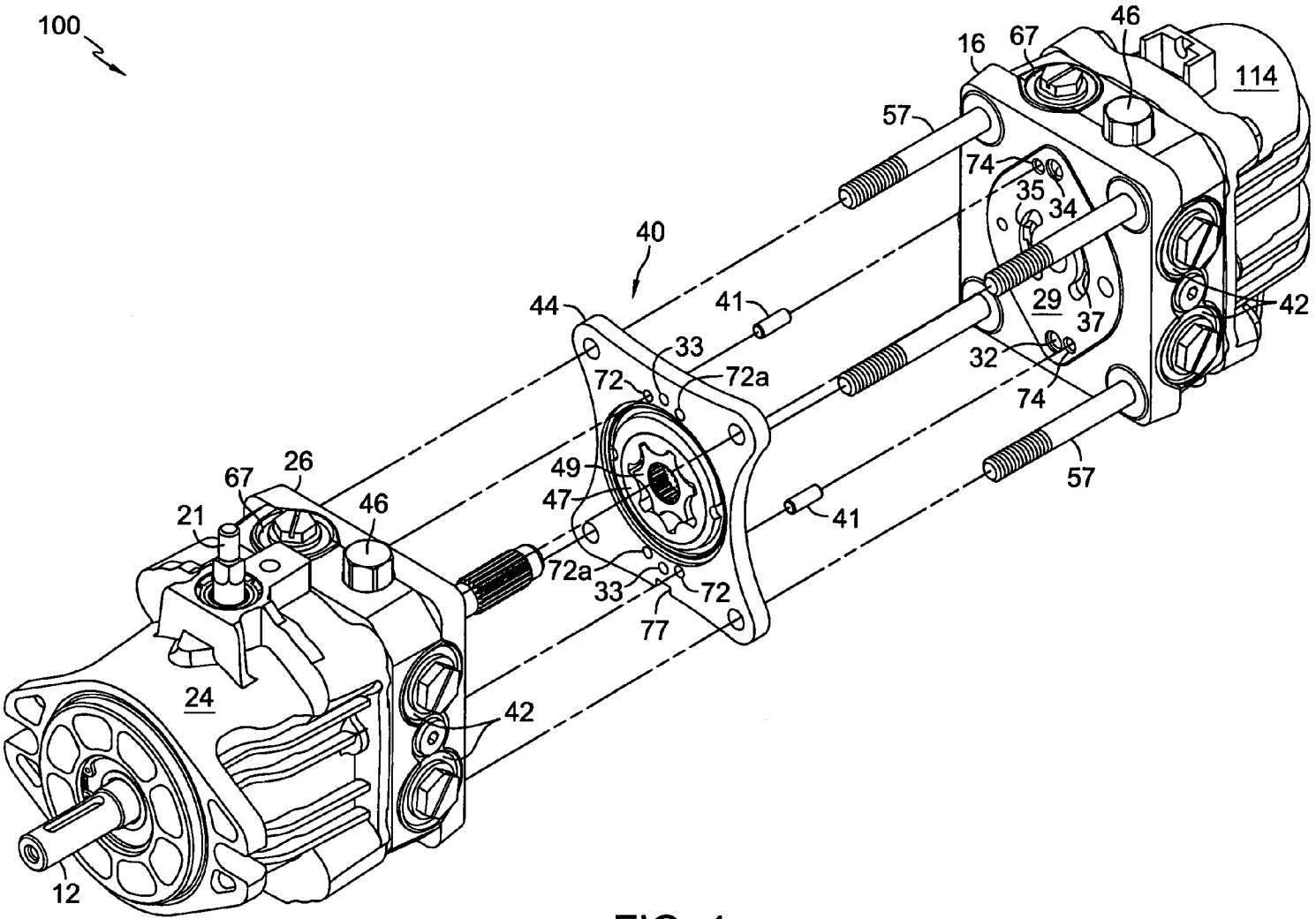
FIG. 4 is an exploded view of the dual pump apparatus shown in FIG. 3.
Figure 6:
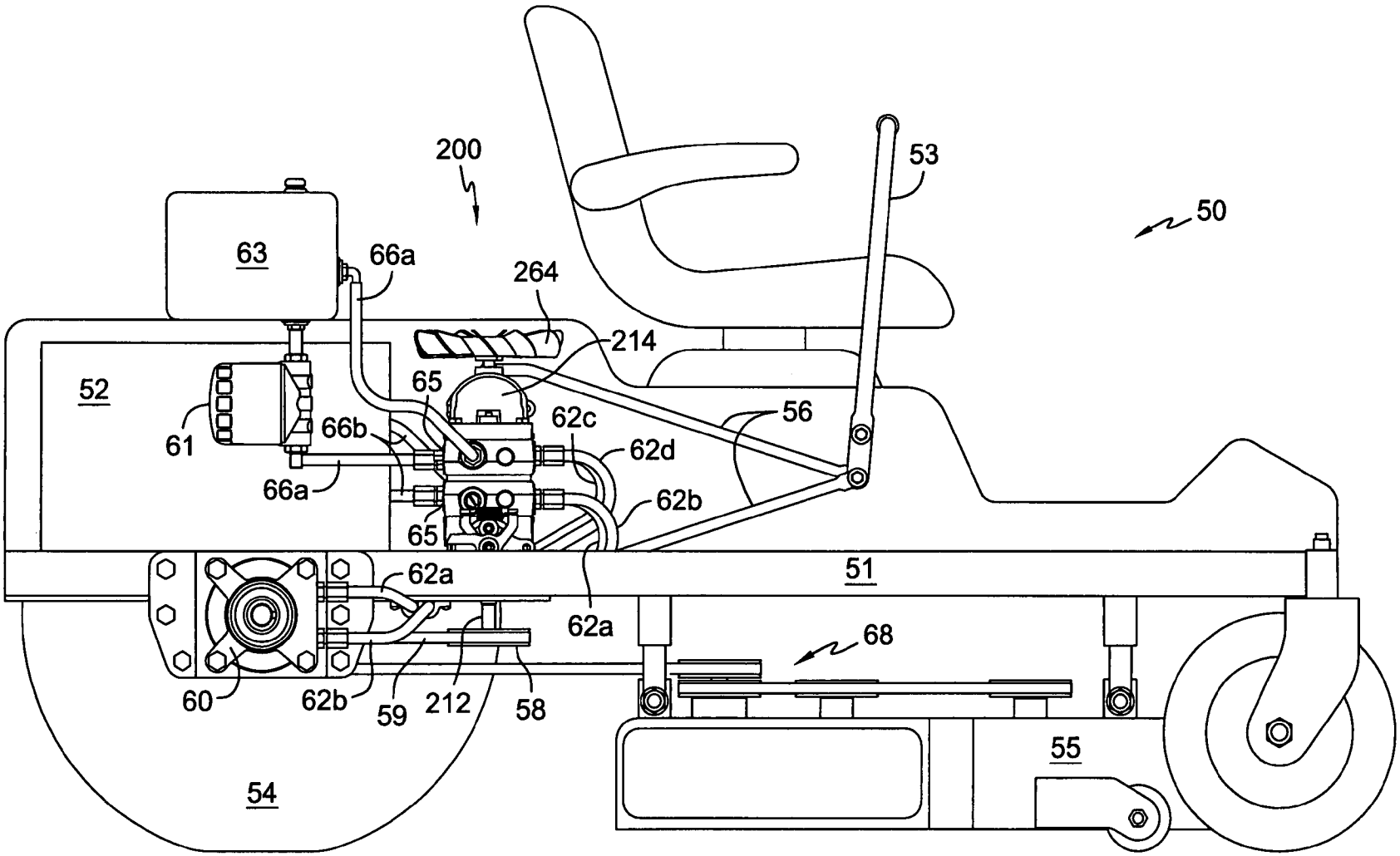
FIG. 6 is an elevational view of an exemplary vehicle incorporating a dual pump apparatus in accordance with a further embodiment of the present invention, with certain features such as a wheel removed to show other aspects of the invention.

FIGS. 1 and 2 show a dual pump apparatus 10 in accordance with a first embodiment of the present invention. FIGS. 3 and 4 show an alternative embodiment dual pump apparatus 100, which is similar to that of FIGS. 1 and 2 in most respects except in the structure of housing 114. In FIGS. 1 and 2, housing 14 includes an access hole 18 to assist in the final assembly of the unit; plug 45 is then placed in access hole 18 for operation. This optional access hole is not included in housing 114 of FIG. 4. In both embodiments, input shaft 12 does not extend out of housing 14 or housing 114. The application view of FIG. 6 depicts a further alternative embodiment dual pump apparatus 200, where input shaft 212 is a through-shaft extending out of housing 214 to power cooling fan 264. Since these embodiments are generally identical otherwise, the invention will be described herein with respect to the embodiments shown in FIGS. 1–4.

As shown most clearly in FIG. 2, this apparatus includes a single pump input shaft 12 that drives both pumps. A first pump apparatus comprises housing 14 secured to a porting member such as end cap 16 to form internal sump 15; such porting members are also sometimes referred to as center sections. The second pump apparatus similarly comprises housing 24 secured to end cap 26 to form internal sump 17. In a preferred embodiment, a single set of fasteners 57 is used to connect the various housings, end caps and charge pump 40 together as shown most clearly in FIG. 4.

Within the two internal sumps 15 and 17 are mounted preferably identical hydraulic cylinder blocks 28 rotatably mounted on a pump running surface 22 formed on the respective end caps 16, 26. A valve plate (not shown) may also be disposed on end caps 16, 26 to provide a running surface for cylinder blocks 28. When a pump is described as being disposed on or mounted on a running surface, it is generally understood to include either direct mounting thereon or including a valve plate between the cylinder block (or gerotor) and the running surface. A plurality of pistons 31 are mounted within the cylinder blocks 28 and are engaged to a swash plate assembly 27 which is moved by means of a control shaft or trunnion arm 21. Both cylinder blocks 28 are preferably splined to and driven by single pump input shaft 12. The general arrangement of the hydraulic cylinder blocks, control arms and related structure is well-known in the art and will not be described further herein. In addition, various bearings 38 and 39 may be included as needed depending on the application.

End cap 16 includes hydraulic porting 30 while end cap 26 includes hydraulic porting 36; in both instances, the hydraulic porting is intended to connect the cylinder blocks 28 to external hydraulic lines and charge pump 40, all of which will be described herein. In FIG. 2, one can see two separate fluid passages 32 and 34 which include openings 33 formed in charge pump housing or plate 44, intended to provide a line of fluid communication between sumps 15 and 17. In practice, only one such case drain is necessary in most applications, but two case drains are being depicted here to show flexibility in the location of the case drain. Each end cap will preferably include a pair of system ports 42 (shown in FIGS. 1, 3 and 4 with a shipping plug installed), a bypass valve 43 and a pair of check valves 46.

Figure 5:
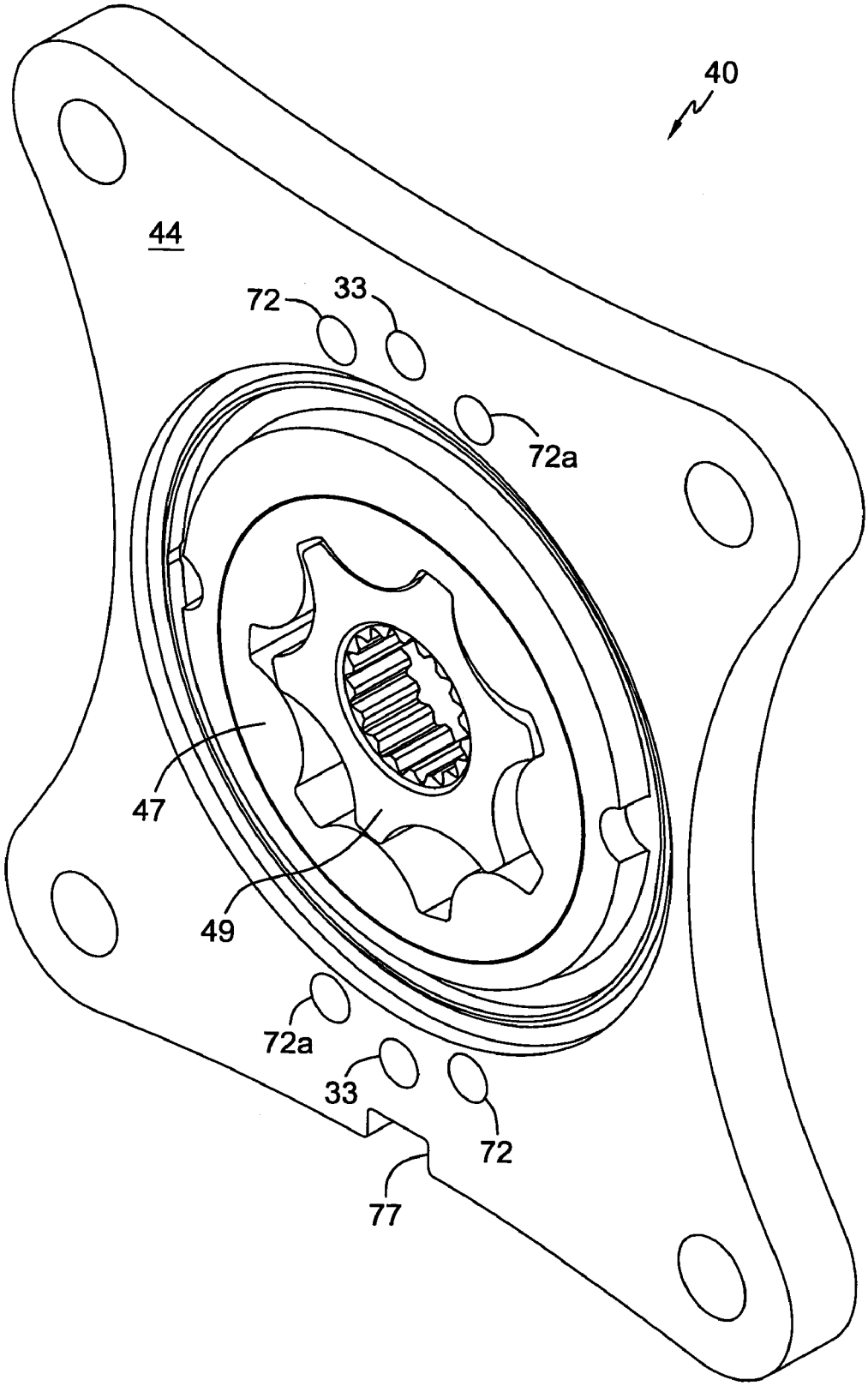
FIG. 5 is a perspective view of the charge pump and its housing in accordance with this invention.

Charge pump 40 is preferably sandwiched between the external surfaces of end caps 16 and 26 and, as shown, comprises a gerotor pump further comprising outer gerotor element 47 and inner gerotor element 49 engaged to and also driven by pump input shaft 12. Charge pump 40, shown most clearly in FIGS. 4 and 5, comprises housing plate 44 sandwiched between end caps 16 and 26, and secured by means of fasteners 57. This design eliminates the need for a separate intermediate member between the two end caps 16, 26. A charge pump running surface 29 is formed on the outer side of end cap 16, opposite to pump running surface 22; a similar charge pump running surface is formed on end cap 26. The two piece gerotor assembly 47, 49 is powered by input shaft 12 through a spline and provides charge fluid to both hydraulic porting 30 in end cap 16 and hydraulic porting 36 in end cap 26. Using end cap 16 as an example, fluid flows from a reservoir 63, as shown in FIG. 6 into one or more inlets 65, which are shown with shipping plugs installed in FIG. 1, then into port 35 and into gerotor assembly 47, 49. The output of gerotor assembly 47, 49 flows into inlet 37 and then into a charge gallery (not shown). Charge galleries are known and are described in, for example, commonly owned U.S. Pat. No. 6,889,595, the terms of which are incorporated herein by reference.

To assist in the positioning of housing plate 44, a pair of pins 41 may extend through holes 72 and into a set of openings 74 formed on charge pump running surface 29 of end cap 16 to locate pins 41. Another set of similar openings are formed on the charge pump running surface (not shown) of end cap 26. An alternative set of holes 72*a* may also be formed in housing plate 44 so that charge pump 40 may be rotated 180 degrees with respect to input shaft 12 to increase the flexibility of the unit. As an example, rotation of housing plate 44 by 180° with respect to end caps 16, 26 may allow the direction of rotation of shaft 12 to be reversed. To prevent improper assembly, a notch 77 is provided on one side of housing plate 44 to serve as a visual aid to achieve the desired orientation during assembly. It will also be understood that pump housings 14, 114 and 214 in the various embodiments depicted herein, along with the respective swash plate 27 and trunnion arm 21, may be rotated 180 degrees about the axis of input shaft 12 or 212 so that both trunnion arms 21 are on the same side of the unit.

A preferred application for dual pump apparatus 200 is shown in FIG. 6, where exemplary vehicle 50 is depicted having a prime mover 52 mounted on frame 51. One drive wheel 54 of vehicle 50 was removed so that one can see the arrangement of the various drive elements. Dual pump apparatus 200 is also mounted on frame 51 and pump input shaft 212 can be seen as being driven by pulley 58, which is powered by belt 59 from prime mover 52. Pump apparatus 200 could also be mounted horizontally in vehicle 50 for direct drive by prime mover 52.

As discussed previously, cooling fan 264 is mounted on and powered by pump input shaft 212, which is a through-shaft in this embodiment. Mower deck 55 is also shown as being mounted on frame 51 and is powered by belt and pulley assembly 68 in a known manner. A hydraulic motor 60 is shown for powering the drive wheels 54; the other hydraulic motor is not shown. Motor 60 is connected to end cap 26 through hydraulic lines 62*a* and 62*b*, and lines 62*c* and 62*d* connect end cap 16 to the second hydraulic motor (not shown). Additional hydraulic lines 66*a* and 66*b* connect at least one case drain port 67 of hydraulic pump apparatus 200 to reservoir 63 and include a connection to oil filter 61. Note that only one case drain port 67 need be used if at least one fluid passage 32, 34 is available to connect the fluid sumps contained within housing 24 and within housing 14, 114 or 214.

The exemplary vehicle 50 also includes linkage 56 attached to control arm 53 for connecting pump apparatus 200 and for enabling control by the user. It will be understood that this exemplary application includes various features which are preferred but which are not critical to the use of the invention disclosed herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed:

1. A hydraulic pump apparatus comprising:

a first end cap having a first surface and a second surface, and a first charge pump running surface formed on the second surface;

a first housing mounted to the first end cap to form a first sump, wherein at least a portion of the first surface is located in the first sump;

a second end cap having a third surface and a fourth surface, and a second charge pump running surface formed on the fourth surface;

a second housing mounted to the second end cap to form a second sump, wherein at least a portion of the third surface is located in the second sump; and a charge pump comprising a charge pump housing separate from both end caps and located immediately adjacent to the second and fourth surfaces, wherein the charge pump is disposed on both the first and second charge pump running surfaces.

2. The hydraulic pump apparatus of claim 1, further comprising a first axial piston pump disposed on the first surface of the first end cap and within the first sump, a second axial piston pump disposed on the third surface of the second end cap and within the second sump, and a shaft directly and simultaneously driving the first axial piston pump, the second axial piston pump, and the charge pump.

3. The hydraulic pump apparatus of claim 2, further comprising a first swash plate and a first trunnion rotatable to move the first swash plate, a second swash plate and a second trunnion rotatable to move the second swash plate, wherein the first trunnion extends in a first direction from the hydraulic pump apparatus and the second trunnion extends in a second direction generally opposite the first direction.

4. The hydraulic pump apparatus of claim 2, wherein the charge pump has a first position corresponding to a first shaft rotation direction and a second position approximately 180 degrees from the first position corresponding to a second shaft rotation direction.

5. The hydraulic pump apparatus of claim 2, further comprising a fan directly driven by the shaft.

6. The hydraulic pump apparatus of claim 5, wherein the shaft is driven by a prime mover at a first end and the shaft drives the fan at a second end.

7. The hydraulic pump apparatus of claim 1, further comprising a fluid passage extending through the first end cap, the charge pump and the second end cap to connect the first sump to the second sump.

8. The hydraulic pump apparatus of claim 1, further comprising a first hydraulic circuit formed in the first end cap and a second hydraulic circuit formed in the second end cap, whereby the charge pump provides hydraulic fluid to both the first and second hydraulic circuits.

9. A hydraulic pump apparatus comprising:

a first pump assembly comprising a first end cap having a first surface and a second opposite surface, a first pump cylinder block disposed on the first surface and a first housing mounted to the first end cap to form a first sump;

a second pump assembly comprising a second end cap having a third surface and a fourth opposite surface, a second pump cylinder block disposed on the third surface and a second housing mounted to the second end cap to form a second sump;

a charge pump positioned directly between and engaging both the second and fourth surfaces; and an input shaft comprising a first end external to the hydraulic pump apparatus and a plurality of internal portions that engage and simultaneously drive the first pump cylinder block, the second pump cylinder block and the charge pump.

10. The hydraulic pump apparatus of claim 9, further comprising a first swash plate and a first trunnion rotatable to move the first swash plate, a second swash plate and a second trunnion rotatable to move the second swash plate, wherein the first trunnion extends in a first direction from the hydraulic pump apparatus and the second trunnion extends in a second direction generally opposite the first direction.

11. The hydraulic pump apparatus of claim 9, wherein the charge pump has a first position corresponding to a first input shaft direction of rotation and a second position approximately 180 degrees from the first position corresponding to a second input shaft direction of rotation.

12. The hydraulic pump apparatus of claim 9, further comprising a fluid passage extending through the first end cap, the charge pump and the second end cap to fluidly connect the first pump assembly to the second pump assembly.

13. The hydraulic pump apparatus of claim 9, further comprising a fan directly driven by the input shaft.

14. The hydraulic pump apparatus of claim 13, wherein the input shaft is driven by a prime mover at a first end and the input shaft drives the fan at a second end.

15. A hydraulic pump apparatus comprising:

a first housing and a second housing;

a first end cap secured to the first housing to form a first sump, the first end cap comprising a first pump running surface, a first hydraulic circuit and a first charge pump running surface;

a first hydraulic pump disposed on the first pump running surface and in fluid communication with the first hydraulic circuit;

a second end cap secured to the second housing to form a second sump, the second end cap comprising a second pump running surface, a second hydraulic circuit and a second charge pump running surface;

a second hydraulic pump disposed on the second pump running surface and in fluid communication with the second hydraulic circuit;

a charge pump captured directly between and adjacent to the first end cap and the second end cap, wherein the charge pump is disposed on both the first and second charge pump running surfaces and provides hydraulic fluid directly to at least one of the first and second hydraulic circuits; and a fluid passage extending through the first end cap, the charge pump and the second end cap to fluidly connect the first sump directly to the second sump.

16. The hydraulic pump apparatus of claim 15, further comprising:

a shaft connected to a prime mover and engaged to and driving the first hydraulic pump, the second hydraulic pump and the charge pump; and a first swash plate and a first trunnion rotatable to move the first swash plate, a second swash plate and a second trunnion rotatable to move the second swash plate, wherein the first trunnion extends in a first direction from the hydraulic pump apparatus and the second trunnion extends in a second direction generally opposite the first direction.

17. The hydraulic pump apparatus of claim 16, wherein the charge pump has a first position corresponding to a first shaft direction of rotation and a second position approximately 180 degrees from the first position corresponding to a second shaft direction of rotation.

18. The hydraulic pump apparatus of claim 16, further comprising a fan directly driven by a first end of the shaft, wherein the shaft is driven by a prime mover at a second end.

19. The hydraulic pump apparatus of claim 15, wherein the charge pump provides hydraulic fluid to both the first and second hydraulic circuits.

* * * * *